United States Patent [19]

Fujisawa

[11] Patent Number: 4,935,783

[45] Date of Patent: Jun. 19, 1990

[54] DEVELOPER SUPPLY SYSTEM

[75] Inventor: Shuji Fujisawa, Osaka, Japan

[73] Assignee: Mita Industrial Co., Ltd., Osaka, Japan

[21] Appl. No.: 250,739

[22] Filed: Sep. 28, 1988

[30] Foreign Application Priority Data

Sep. 30, 1987 [JP] Japan ..... 248982

[51] Int. Cl.[5] ..... G03G 15/08

[52] U.S. Cl. ..... 355/246; 118/688

[58] Field of Search ..... 355/245, 246, 260, 208; 118/689, 691, 693, 694; 222/DIG. 1

[56] References Cited

U.S. PATENT DOCUMENTS

| | | | |
|---|---|---|---|
| 4,423,948 | 1/1984 | Kimura et al. | 118/689 X |
| 4,558,659 | 12/1985 | Alden | 355/245 X |
| 4,682,874 | 7/1987 | Fantuzzo | 355/246 X |
| 4,711,551 | 12/1987 | Fujio et al. | 355/245 X |
| 4,758,861 | 7/1988 | Nakamaru et al. | 118/691 X |

FOREIGN PATENT DOCUMENTS

| | | |
|---|---|---|
| 56-102874 | 8/1981 | Japan . |
| 56-150774 | 11/1981 | Japan . |
| 58-91478 | 5/1983 | Japan . |
| 59-71065 | 4/1984 | Japan . |

*Primary Examiner*—Joan H. Pendegrass
*Attorney, Agent, or Firm*—Koda & Androlia

[57] ABSTRACT

A developer supply system wherein a spiral and the like provided at a supply opening positioned above a developing unit is rotated in response to a signal from a developer sensor disposed in a place corresponding to a determined position on the way to the supply side from the center of said supply opening on the side of the developing unit so as to transport a developer contained within a developer supply tank from the supply side of said supply opening to the terminal side until the developer falls into the developer unit.

1 Claim, 5 Drawing Sheets

DEVELOPER SUPPLY SYSTEM

BACKGROUND OF THE INVENTION

1. Field of the Invention

The present invention relates to a developer supply system or particularly to an improvement of the developer supply system employing a process for feeding in a horizontal direction a developer by the rotations of a spiral, screw roller, etc. from the developer supply side of a supply opening to the terminal side until the developer falls down into a developing unit.

2. Description of the Prior Art

A conventional developer supply system 11 will be described with reference to FIGS. 3–5. FIG. 3 uses two reference numbers 1 and 11 to identify the developer supply system because it is in common with the developer supply system 1 in accordance with the present invention.

The developer supply system 11 is mounted on a developing unit 10. Said developing unit 10 has a developer sensor 3 for detecting the concentration of developer (concentration of toner in case of use of a developer of two-component system). If the concentration of developer is lowered, a spiral 4 is rotated by means of a drive mechanism 7. When the spiral 4 is put in motion, a developer contained within a developer supply tank 2 is transported in a horizontal direction in a pipe 5 and fallen from a supply slit 6 (supply opening) into the developing unit 10. For the purpose of having a uniform distribution of the developer in drop rate, a portion of the supply slit 6 near the supply side for the developer is formed at such a high level that when piled up considerably high within the pipe 5, the developer will fall down, while another portion of the supply slit 6 near the terminal side (opposite to the supply side) is formed at a low level so that the developer may fall down even if the developer within the pipe 5 has become low due to supply of the developer to the developing unit.

The developer sensor 3 is provided in a position corresponding to the center of the supply slit 6. This arrangement makes it possible to detect decreasing of the developer at the center because the developer tends to be consumed to the greatest degree at this point when smallsized objects to be copied are subjected to repeated copying operations.

FIGS. 5(*a*)–(*d*) are views showing the change of the conventional developer supply system 11 in the operational phase with time.

FIG. 5(*a*) shows an initial state of operation wherein the developer T has started to be supplied from the developer supply tank 2 to the supply slit 6. Dropping of developer T into the developer unit 10 is only limited to a portion where the developer T has reached the supply slit 6. Further continuous rotation of the spiral 4 allows the developer T to arrive at the other side of the supply slit 6, which state is shown by FIG. 5(*b*).

In this state of FIG. 5(*b*), the developer T has been distributed substantially uniform in the range between the end of one side (supply) and the end of the other side (terminal) of the supply slit 6. The driving of the spiral 4 is controlled in response to a signal from the developer sensor 3. If the concentration of developer is decreased, the spiral 4 is activated to supply the developer from the developer supply tank 2 until the developer falls from the supply slit 6. And if the concentration of developer is sufficiently increased, the spiral 4 is stopped and the supply of the developer is discontinued.

This will establish a balance between the drop of developer from the supply slit 6 and the supply of developer from the developer supply tank 2, and the height of the developer within the pipe 5 may be maintained at a determined level.

As shown by FIG. 5(*c*), however, when the developer supply tank 2 is exhausted, thereby resulting in a discontinuation of supply of the developer T to the pipe 5, the developer T is too reduced in quantity to continue to dropping at the area near the end of the supply side of the supply slit 6, and then, the dropping of the developer will take place only at the area near the end of the terminal side. And when the area where insufficient amount of developer remains spreads over to a position corresponding to the center of the supply slit 6, the developer sensor 3 acts to detect it, and then the spiral 4 is actuated to deliver a fresh developer. However, since a rotation of the spiral 4 fails to overcome the deterioration of the developer in concentration, it will be determined that the developer supply tank 2 has been exhausted. Consequently, it is impossible to detect the developer supply tank 2 being emptied until the area with no sufficient developer left spreads from the end of the supply side of the supply slit 6 over to the center. Namely, there lies a problem that the arrangement of the prior art involves a time delay in determining that the developer supply tank 2 no longer contains a developer. Further problem is that there may create non-uniformity in concentration of developer that the specified concentration of developer fails to remain, rather being inclined downward at the area of the developing unit 10 close to the supply side of the supply slit 6, whereas at the other area of the developing exist unit 10 close to the terminal side increasing of the concentration of developer exist.

There is another problem that even though the developer $T_2$ is added to the empty developer supply tank 2 after the detection of its emptiness, as shown by FIG. 5(*d*), a portion through which no developer drops may occur between the portion from which the old developer $T_1$ drops upon delivered to the terminal side of the supply slit 6 and the portion through which the developer $T_2$ drops after reached the end of the supply side of the supply slit 6, whereby some time is required until the uniform distribution of developer in drop rate is obtained again.

SUMMARY OF THE INVENTION

The present invention was made in view of the foregoing state of art.

The subject of this invention consists in providing a developer supply system, wherein a spiral and the like disposed in an opening for supply positioned above a developing unit are rotated in response to a signal from a developer sensor provided at the side of the developing unit to feed a developer contained in the developer supply tank from the supply side of said supply opening to the terminal side until the developer falls into the developing unit, with an arrangement that said developer sensor is located in a position corresponding to a determined position on the midway to the supply side from the center of said supply opening.

Hence, in said developer supply system, when the developer supply tank is exhausted, the presence of such an emptiness can be detected more rapidly than that in the conventional system.

This may reduce to a minimum the time of the concentration of developer within the developing unit and of the distribution of developer in drop rate from the supply opening remaining non-uniform.

DETAILED DESCRIPTION OF THE PREFERRED EMBODIMENTS

Figure 1:
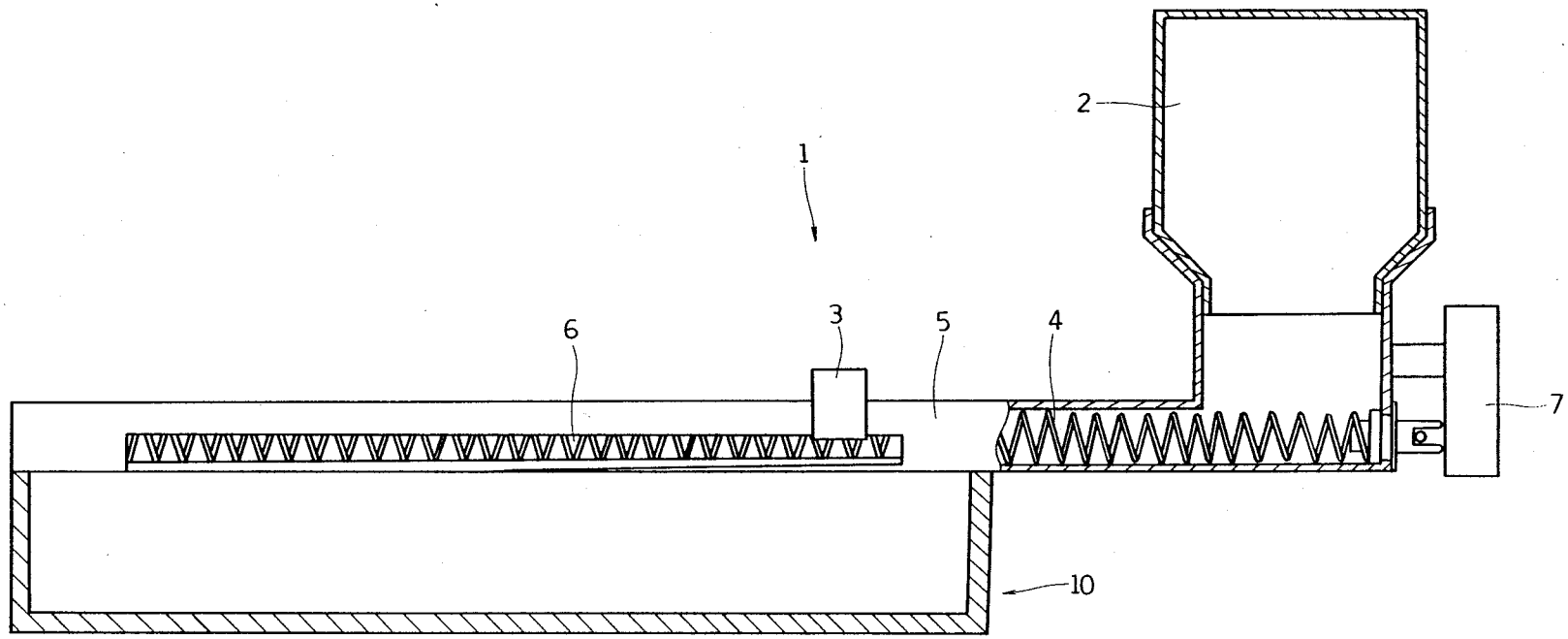
FIG. 1 is a constructive conceptual view of a developer supply system embodying the present invention, including a partially cut-away view thereof, FIG. 2(*a*) is a typical conceptual view showing an initial state of operation of the system of FIG. 1.
Figure 2A:
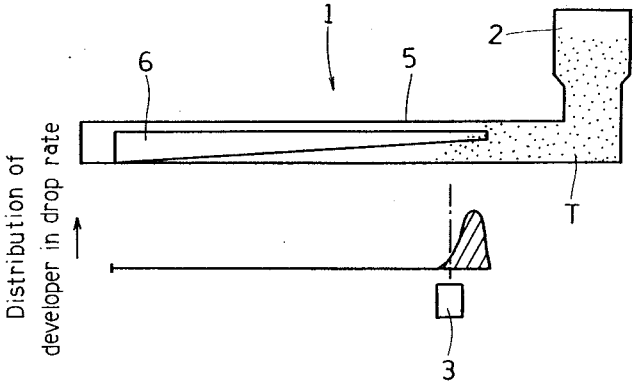
FIG. 2(*b*) is a typical conceptual view showing a normal state of operation of said system, FIG. 2(*c*) is a typical conceptual view showing the developer supply tank of said system being detected empty of the developer, FIG. 2(*d*) is a typical conceptual view showing said system being additionally supplied with a new developer after the detection.
Figure 2B:
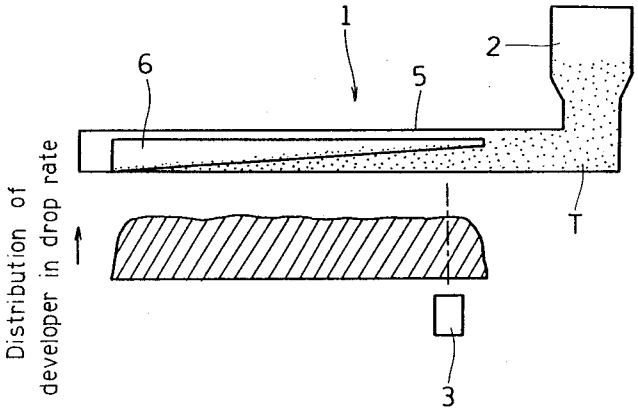
Figure 2C:
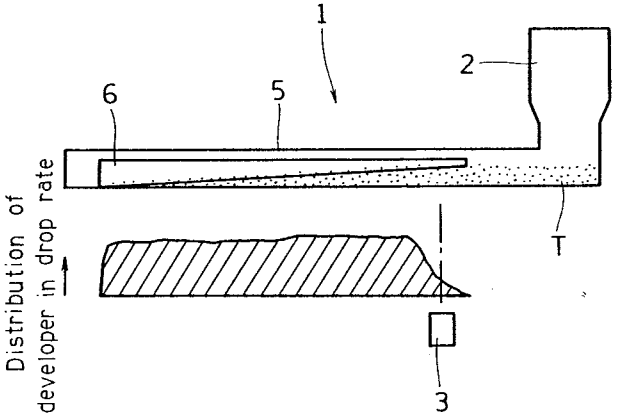
Figure 2D:
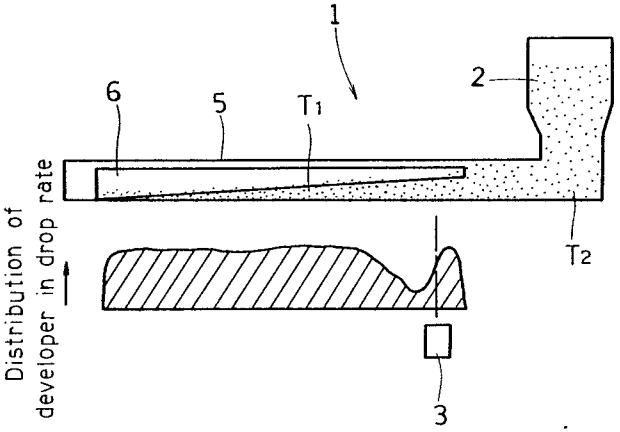

A developer supply system 1 as shown in FIG. 1 comprises a developer supply tank 2, a developer sensor 3, a spiral 4, a pipe 5, a supply slit, 6 (supply opening), and a spiral driving mechanism 7. These respective components are identical to the known conventional components, having the like reference numbers.

Figure 4:
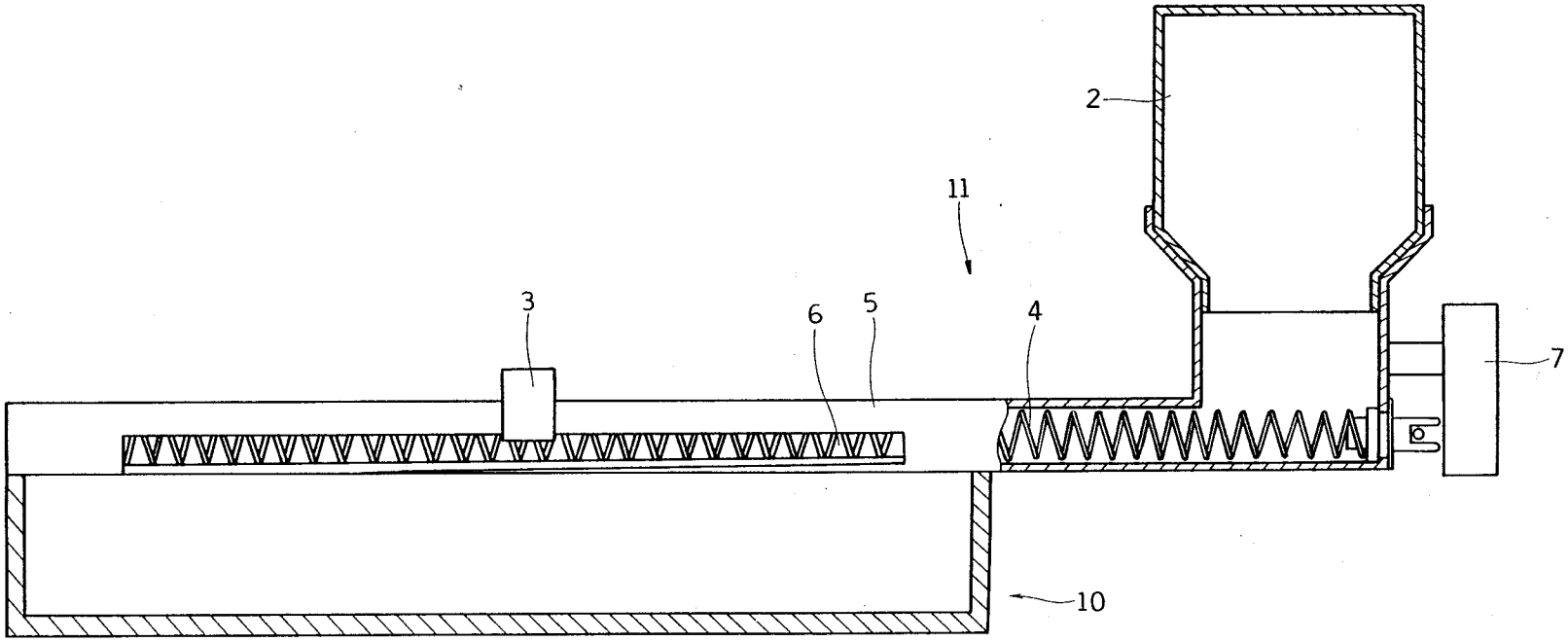
FIG.4 PRIOR ART
FIG. 4 is a view corresponding to FIG. 1, showing one embodiment of conventional developer supply systems, and FIGS. 5(*a*), (*b*), (*c*), and (*d*) are views corresponding to FIGS. 2(*a*), (*b*), (*c*), and (*d*) in the conventional system shown by FIG. 4.
Figure 5A:
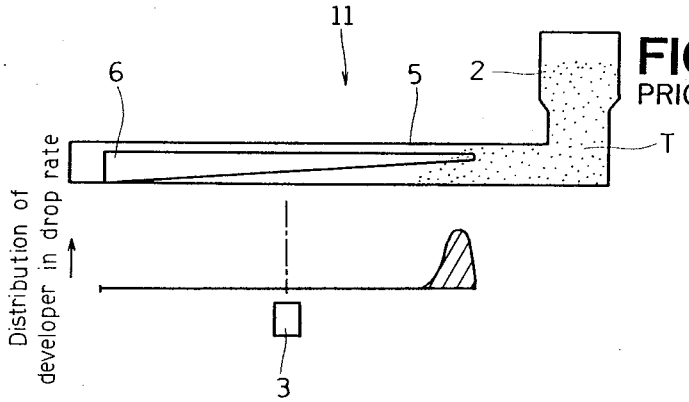
FIG.5a PRIOR ART
Figure 5B:
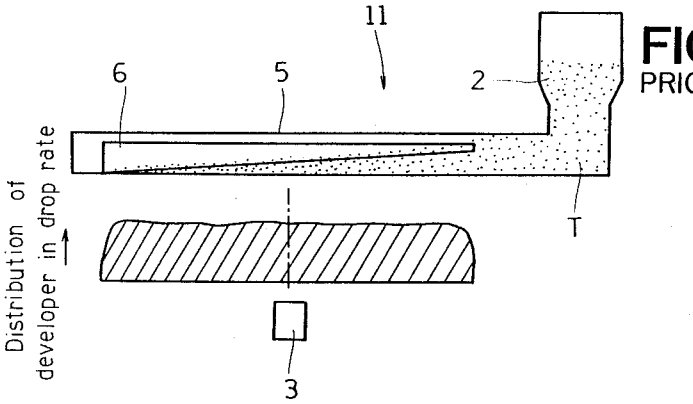
FIG.5b PRIOR ART
Figure 5C:
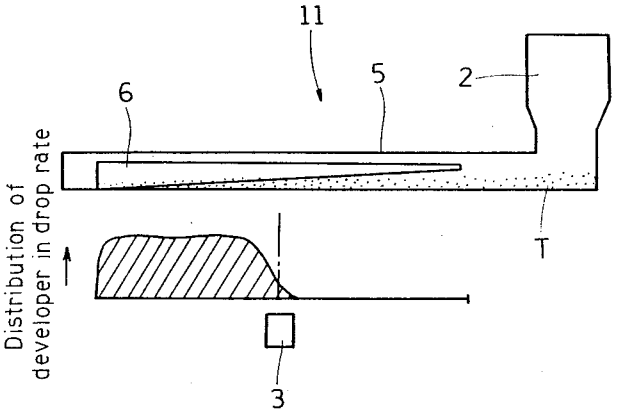
FIG.5c PRIOR ART
Figure 5D:
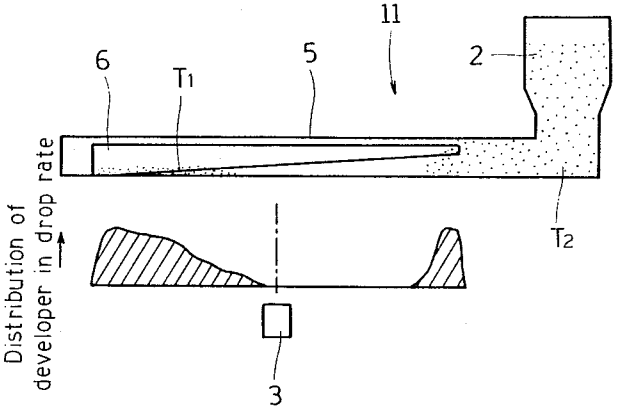
FIG.5d PRIOR ART

The developing supply system 1 is different from the conventional developing supply system 11 shown in FIG. 4 in that the position where the developer sensor 3 is placed corresponds to the position closer to the supply side rather than to the center of the supply slit 6.

It is to be noted that the distance by which the developer sensor 3 is brought to a position near the supply side corresponds, for example, to about a half the width of the typical smallest one of the sheets of various sizes to be copied, directed transversely of the supply slit.

Also, for example, if the developing unit 10 has a width of 326 mm and the supply slit 6 has a width of 250 mm so that the both members are in agreement with each other in their center points, the, developer sensor 3 may be disposed in a position corresponding to the position on the supply side which is remote by 71 mm from the center. In short, any position between the center of supply slit 6 and the end of supply side can simply be used which enables both decrease of the concentration of developer within the developing unit 10 and emptiness of the developer supply tank 2 to be detected rapidly.

Figure 3:
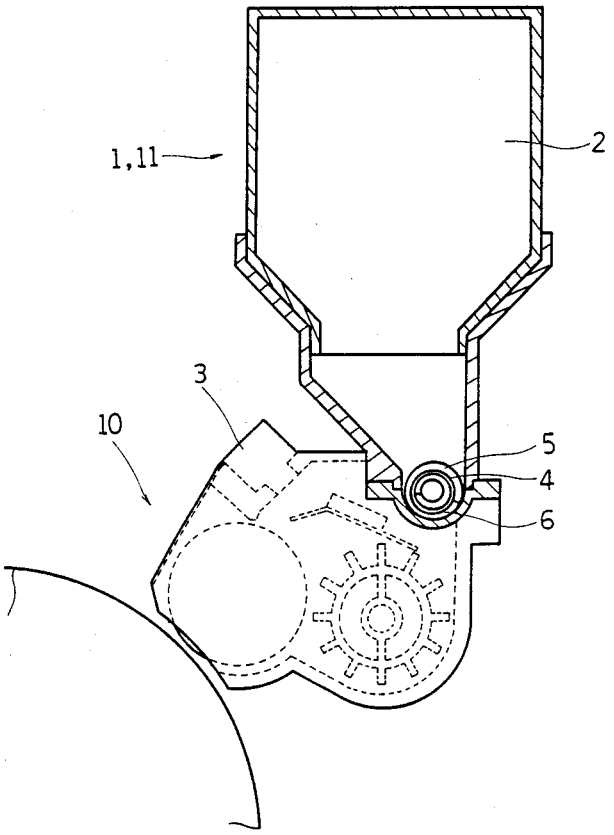
FIG. 3 is a typical side view of said system, including a partially cut-away view thereof.

The system of the present invention is identical to the conventional developer supply system 11 in the structure except for the fact that the developer sensor 3 is situated closer to the supply side than to the center of the supply slit 6, and thus the arrangement of the present invention is same as that of the prior art as long as the side view is concerned, which is by FIG. 3.

Now, various states of the developer supply system 1 will be described with reference to FIGS. 2(*a*)–(*d*).

FIG. 2(*a*) illustrates an initial operation state of the system 1. The spiral 4 is kept rotating continuously until the concentration of the developer within the developing unit 10 reaches a determined level. At this time, the developer T contained in the developer supply tank 2 is transported in a horizontal direction in the pipe 5. And, the developer T starts falling down from the end of the supply side of the supply slit 6, the falling portion of the developer T spreading as far as the end of the terminal side.

As shown in FIG. 2(*b*), when the developer T arrives at the terminal side of the supply slit 6, the developer T will drop in a uniform manner in any place of the supply slit 6. Then, the concentration of the developer within the developing unit 10 will be increased, and when it is detected by the developer sensor 3 that the determined level has been reached, the rotation of the spiral 4 is stopped, with the consequential stop of dropping of the developer T.

When the concentration of developer within the developing unit 10 is decreased by the consumption of the developer T for copying operation, the developer sensor 3 acts to detect the decrease. Then, since the spiral 4 is driven to restart, the developer T is delivered from the developer supply tank 2 to the pipe 5. And, only a supplied amount of the developer T falls down from the supply slit 6 to the developing unit 10.

This helps keep the balance between the amount of the developer T supplied from the developer supply tank 2 and the amount of the developer T fallen from the supply slit 6, so as to maintain the developer T at the determined level inside the pipe 5, while the concentration of developer within the developing unit 10 is also maintained within a determined range.

However, as shown in FIG. 5(*c*), if the developer supply tank 2 is exhausted, the supply of the developer T to the pipe 5 will be discontinued. On the other hand, if the spiral 4 is driven to rotate, the developer T remaining within the pipe 5 is fed toward the terminal side of the supply slit 6 to fall down, so the level of the developer T at the supply side within the pipe 5 will be lowered. This will prevent the developer T from falling down in sequence from the end of the supply side of the supply slit 6.

Then, a detection is made by the developer sensor 3 of the reduction of the concentration of developer within the developing unit 10, and if the spiral 4 is rotated accordingly, the concentration of developer will no longer be increased, whereby it can be detected that the developer supply tank 2 in void. In accordance with the developer supply system 1 of the present invention, since the developer sensor 3 is located on the way to the supply side from the center of the supply slit 6, as shown in FIG. 2(*c*), a quicker detection may be made of the developer supply tank 2 being empty of developer than in the conventional case. This makes it possible to limit the decreasing of the concentration of developer to only a few amount of the developer.

Now, as shown in FIG. 2(*d*), after the detection of the emptiness of the developer supply tank 2, a fresh developer $T_2$ is added to the developer supply tank 2. At this time, the level of the old developer $T_1$ remaining within the pipe 5 is still not so low that the developer $T_1$ is instantly connected with the new developer $T_2$, thus reulting a prompt and uniform distribution of the developer in drop rate. Namely, the state of FIG. 2(*b*) is returned in quick manner.

As described above, in accordance with the developer supply system 1, the emptiness of the developer supply tank 2 may be detected with no delay. And also, the time of the concentration of developer within the developing unit 10 remaining non-uniform as well as the time of the developer being distributed non-uniform in its drop rate from the supply slit 6 may be reduced to a minimum.

In the above-mentioned embodiment, instead of said supply slit 6, the opening for the supply of developer may be constituted by a plurality of apertures having different inner diameters consecutively arranged to extend from the supply side of the developer to the terminal side.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

I claim:

1. A developer supply system, wherein a spiral and the like provided in a supply opening positioned above a developing unit is rotated in response to a signal from a developer sensor disposed on the side of the developing unit so as to transport a developer contained within a developer supply tank from the supply side of said supply opening to the terminal side until the developer falls into the developing unit, characterized in that said developer sensor is located in a place corresponding to a determined position on the way to the supply side from the center of said supply opening.

* * * * *